US010932034B2

(12) United States Patent
Gu

(10) Patent No.: US 10,932,034 B2
(45) **Date of Patent: *Feb. 23, 2021**

(54) SOUND GENERATOR

(71) Applicant: AAC Technologies Pte. Ltd., Singapore (SG)

(72) Inventor: Xiaojiang Gu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 16/524,145

(22) Filed: Jul. 28, 2019

(65) Prior Publication Data

US 2020/0045404 A1 Feb. 6, 2020

(30) Foreign Application Priority Data

Aug. 1, 2018 (CN) ..... 2018 2 1236234 U

(51) Int. Cl.
*H04R 1/28* (2006.01)
*H04R 9/02* (2006.01)

(52) U.S. Cl.
CPC ..... *H04R 1/288* (2013.01); *H04R 9/025* (2013.01); *H04R 1/2811* (2013.01); *H04R 2400/11* (2013.01); *H04R 2499/11* (2013.01)

(58) Field of Classification Search
CPC ..... H04R 1/288; H04R 1/2811; H04R 9/025; H04R 9/06; H04R 2400/11; H04R 2499/11; H04R 11/02
See application file for complete search history.

(56) References Cited

U.S. PATENT DOCUMENTS

| | | | | |
|---|---|---|---|---|
| 9,344,804 | B2 * | 5/2016 | Chen | H04R 3/00 |
| 2016/0241938 | A1 * | 8/2016 | Huang | H04R 1/023 |
| 2019/0297426 | A1 * | 9/2019 | Xue | H04R 9/047 |

* cited by examiner

*Primary Examiner* — Tuan D Nguyen
(74) *Attorney, Agent, or Firm* — W&G Law Group LLP

(57) ABSTRACT

The present invention provides a sound generator having a permeable isolation assembly including a permeable damper and two gums attached to the opposite ends of the permeable damper. The permeable damper can completely cover two through holes for leakage, two through holes can be covered at the same time with gums pasted only once, which effectively improves production and assembly efficiency.

5 Claims, 2 Drawing Sheets

SOUND GENERATOR

FIELD OF THE PRESENT DISCLOSURE

The embodiments of the invention relate to the electroacoustic components, in particular to a sound generator used in a portable device.

DESCRIPTION OF RELATED ART

Sound generators, also called sound generators, are widely used in portable electronic devices such as mobile phones, laptops, etc. With the rapid development of these portable electronic devices, people have higher and higher requirements for the performance of the sound generators. In addition, with the thinning development of mobile phones, the quality requirements for the sound generators in the mobile phones are becoming higher and higher. The sound generator is a playing device of the voice function and therefore its internal magnetic circuit system directly influences the improvement of the acoustic performance of the product.

A sound generator of a related technology includes a frame, a vibration system fixed on the frame and a magnetic circuit system driving the vibration system to vibrate. The frame, the vibration system and the magnetic circuit system are jointly enclosed in a rear chamber. The magnetic circuit system includes a magnetic yoke fixed on the frame, and the magnetic yoke comprises a bottom wall and a side wall bent and extended from the bottom wall along the vibration direction of the vibration system. The bottom wall bends and extends to the side wall in the direction of the vibration system. A leakage hole is arranged on the bottom wall of the magnetic yoke and a damper cover is fixed on the leakage hole for sound pressure balance.

However, two leakage holes of the speaker in the related technology are symmetrically laid out, and there are two corresponding dampers. Therefore, it is necessary to paste the dampers twice to fix them. With low assembly efficiency, it is not conducive to automatic assembly.

Therefore, it is necessary to provide an improved sound generator to solve the above technical problems.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to exemplary embodiment. To make the technical problems to be solved, technical solutions and beneficial effects of the present disclosure more apparent, the present disclosure is described in further detail together with the figures and the embodiment. It should be understood the specific embodiment described hereby are only to explain the disclosure, not intended to limit the disclosure.

The following specific embodiment is provided to make the readers understand the contents of the present disclosure clearer and more thoroughly but not restrict the present disclosure, wherein, the upper, lower, left and right words indicating directions only refer to the position of the structure shown in the corresponding figure. The one near the center of the sound generator is defined inner side, and the one far from the center of the sound generator is defined the outer side.

Figure 1:
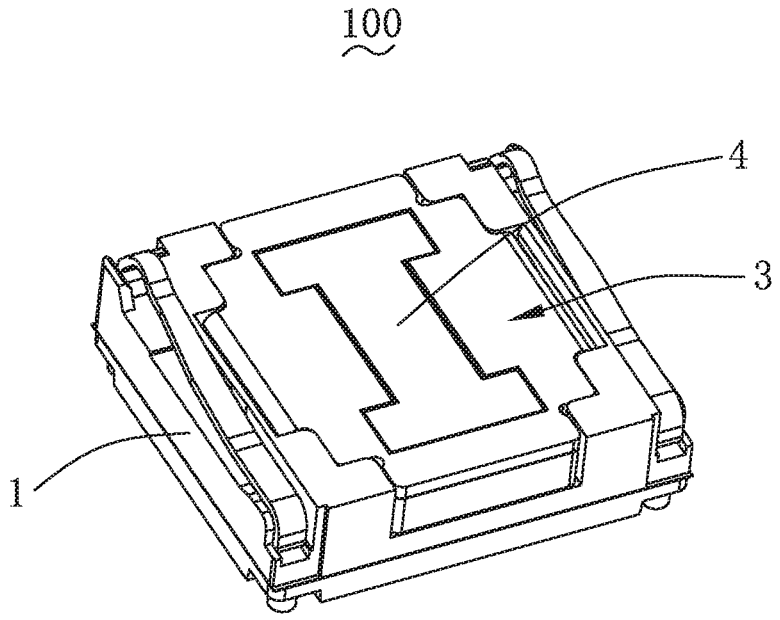
FIG. 1 is an isometric view of a sound generator in accordance with an exemplary embodiment of the invention.
Figure 2:
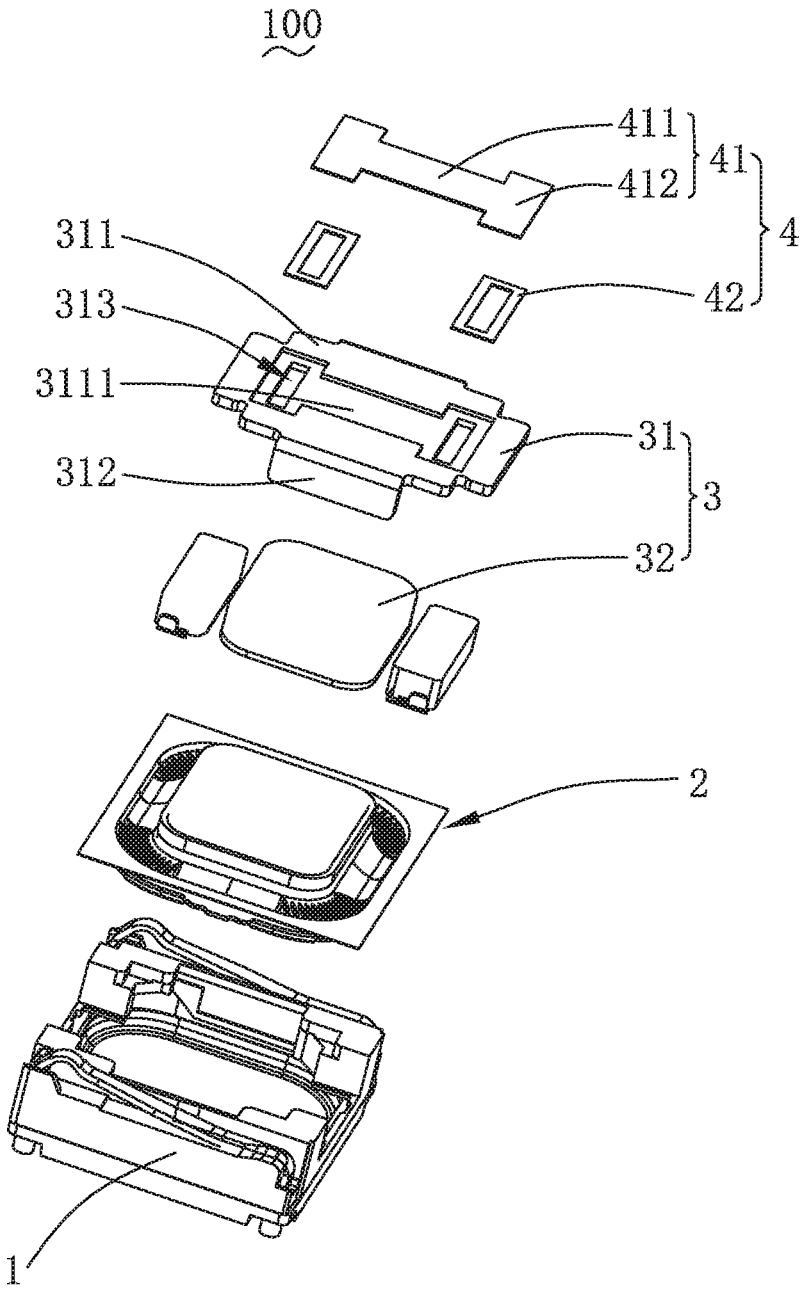
FIG. 2 an isometric and partially exploded view of the sound generator in FIG. 1.

As shown in FIGS. 1-2, the present invention provides a sound generator 100, which comprises a frame 1, a vibration system 2 and a magnetic circuit system 3 fixed to the frame 1 and a permeable isolation assembly 4.

The magnetic circuit system 3 is used to drive the vibration system 2 to vibrate. The frame 1, the vibration system 2 and the magnetic circuit system 3 are jointly enclosed in a rear chamber (un-numbered) for improving the low-frequency acoustic performance of the sound generator 100.

The magnetic circuit system 3 comprises a magnetic yoke 31 fixed to the frame 1 and the magnet 32 fixed to the magnetic yoke 31.

The magnetic yoke 31 comprises a bottom wall 311, a side wall 312 bent and extended from the relative sides of the bottom wall 311 and fixed to the frame 1. At least two through holes 313 are arranged through the bottom wall 311. The through hole 313 is connected with the rear chamber. It should be noted that the magnetic yoke 31 of the present invention can also include only the bottom wall 311 without the side wall 312, and the magnetic yoke 31 can be of flat structure.

In the present embodiment, two through holes 313 are set apart from each other. Of course, the number of through holes 313 is not limited to two, and they are mainly used to balance the sound pressure of the rear chamber.

The two through holes 313 are symmetrically arranged with respect to the center of bottom wall 311, and the symmetrical structure makes the sound pressure in the rear chamber more balanced.

In the present embodiment, two side walls 312 are located on opposite sides of the bottom wall 311, and the two through holes 313 are respectively located on opposite sides of the bottom wall 311. For example, if the sound generator 100 is rectangular, two side walls 312 are located on opposite sides of the long axis of the bottom wall 311; and two through holes 313 are located on opposite sides of the short axis of the bottom wall 311.

It should be noted that the sound generator 100 can be rectangular, circular or in other shapes, and the position of through hole 313 can be set in the same principle.

The through hole 313 is covered with the permeable isolation assembly 4 for blocking foreign particles from entering the rear chamber and protecting reliability of the sound generator 100. The air flow in the rear chamber can flow outside and change the damping of the rear chamber by the permeable isolation assembly 4, thereby improving its low-frequency distortion and acoustic performance.

Specifically, the permeable isolation assembly 4 includes a permeable damper 41 and two back gums 42 attached to opposite ends of the permeable damper 41.

In the present embodiment, the permeable damper 41 comprises a body part 411 and an extension part 412 extending from both ends of the body part 411 respectively. The two extension parts 412 respectively cover the two through holes 313.

The back gum 42 is fixed at the extension part 412, and two back gums 42 are designed to be of annular structure, respectively, and are arranged around two through holes 313. The back gum 42 fixes the permeable damper 41 on the bottom wall 311 and the through holes 313 are completely covered by the permeable damper 41. In the above structure, the permeable damper 41 is of an integral structure. When it is fixed on the bottom wall 311, the two through holes 313 can be completely covered with it only once, and the two through holes 313 need not be covered separately in twice times, thus effectively improving production and assembly efficiency of the sound generator 100.

In the present embodiment, the permeable isolation assembly 4 is attached to the side of the bottom wall 311 far from the vibration system 2 to avoid reduction the chamber of the rear chamber and ensure its low-frequency acoustic performance.

The side of the bottom wall 311 away from the vibration system 2 is sagged in the direction of vibration system 2 to form accommodation slot 3111, for example, the depth of the accommodation slot 3111 is 0.05 mm.

The through hole 313 is set through the accommodation slot 3111, and the accommodation slot of the permeable isolation assembly 4 is fixed in the accommodation slot 3111. On the one hand, the setting of the accommodation slot 3111 reduces the overall production thickness of the sound generator 100, saves the space occupied by the sound generator 100, and is conducive to its miniaturization development; on the other hand, it limits the permeable isolation assembly 4, strengthens fixation and improves stability.

Compared with related technologies, the permeable isolation assembly of the sound generator of the present invention comprises permeable damper and two gums attached to the opposite ends of the permeable damper. The permeable damper is fixed on the bottom wall by gums and permeable damper can completely cover two through holes on the bottom wall at the same time, that is, two through holes can be covered at the same time with gums pasted only once, which effectively improves production and assembly efficiency.

It is to be understood, however, that even though numerous characteristics and advantages of the present exemplary embodiment have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A sound generator, including:

a frame;

a vibration system fixed on the frame;

a magnetic circuit system for driving the vibration system to vibrate;

a rear chamber formed by the frame, the vibration system and the magnetic circuit system; wherein the magnetic circuit system includes a magnetic yoke including a bottom wall and two through holes arranged through the bottom wall and communicated with the rear chamber, and a permeable isolation assembly; the permeable isolation assembly is fixed on the bottom wall and completely covers the through holes; the permeable isolation assembly comprises a permeable damper and two back gums respectively attached to opposite ends of the permeable damper; the two back gums are respectively arranged around the two through holes for fixing the permeable damper on the bottom wall and making the permeable damper completely cover the through holes, the permeable damper comprises a body part and two extension parts respectively extending from opposite ends of the body part, the two extension parts respectively cover the two through holes, the two back gums are respectively fixed at the two extension parts.

2. The sound generator as described in claim 1, wherein the permeable isolation assembly is attached to one side of the bottom wall far from the vibration system.

3. The sound generator as described in claim 1, wherein an accommodation slot is formed in one side of the bottom wall far from the vibration system along a vibration direction of the vibration system, the through hole penetrates through the accommodation slot, and the permeable isolation assembly is fixed in the accommodation slot.

4. The sound generator as described in claim 3, wherein a depth of the accommodation slot is 0.05 mm.

5. The sound generator as described in claim 1, wherein the magnetic yoke further includes a side wall bent and extended respectively from two opposite sides of the bottom wall, the side wall is fixed on the frame, and two through holes are located on the other opposite sides of the bottom wall.

* * * * *